US005679012A

United States Patent [19]

Murata

[11] Patent Number: 5,679,012

[45] Date of Patent: Oct. 21, 1997

[54] ELECTRIC CONNECTION MEMBER, IGNITION APPARATUS FOR INTERNAL COMBUSTION ENGINE AND MANUFACTURING METHOD THEREOF

[75] Inventor: Shigemi Murata, Tokyo, Japan

[73] Assignee: Mitsubishi Denki Kabushiki Kaisha, Tokyo, Japan

[21] Appl. No.: 605,864

[22] Filed: Feb. 23, 1996

[30] Foreign Application Priority Data

Apr. 13, 1995 [JP] Japan ..... 7-088069

[51] Int. Cl.[6] ..... H01R 13/44

[52] U.S. Cl. ..... 439/125

[58] Field of Search ..... 439/125–128; 123/169 PA, 169 PH

[56] References Cited

U.S. PATENT DOCUMENTS 2,118,673 5/1938 Green ..... 439/126
4,715,337 12/1987 Bohl et al. ..... 123/169 PA

FOREIGN PATENT DOCUMENTS 521175 3/1995 Japan .

*Primary Examiner*—Gary F. Paumen
*Attorney, Agent, or Firm*—Sughrue, Mion, Zinn, Macpeak & Seas, PLLC

[57] ABSTRACT

An electric connection member including a cylindrical adaptor means composed of an insulating material and a conductor slidably inserted into the interior of the adaptor means for electrically connecting the ignition coil to the ignition plug and the conductor is composed of a coil spring and a folded wire contact member and electrically connected to the coil spring. With this arrangement, there can be obtained the electric connection member which has high mechanical and electrical reliability to vibration and further is excellent in processability with a low cost.

7 Claims, 9 Drawing Sheets

ELECTRIC CONNECTION MEMBER, IGNITION APPARATUS FOR INTERNAL COMBUSTION ENGINE AND MANUFACTURING METHOD THEREOF

BACKGROUND OF THE INVENTION

1. Field of the Invention

The present invention relates to an electric connection member for use as a connector, and more particularly, to an electric connection member for connecting an ignition coil to an ignition plug in an ignition apparatus for automobiles. Further, the present invention relates to an ignition apparatus for internal combustion engine using the electric connection member and a method of manufacturing the ignition apparatus for internal combustion engine.

2. Description of the Related Art

FIG. 8 and FIG. 9 are cross sectional views showing known ignition apparatuses, wherein the same or corresponding parts are denoted by the same reference numerals. In FIG. 8, reference numeral 1 designates an ignition coil, numeral 2 denotes a harness connected to a unit for driving the ignition coil 1, numeral 3 denotes a cylinder head cover of an internal combustion engine for fixing the ignition coil 1 and numeral 4 denotes mounting bolts. Numeral 5 denotes a high-tension terminal for taking out a high-tension voltage generated at the ignition coil 1 at an ignition timing of the internal combustion engine to the outside and numeral 6 denotes a high-tension tower disposed around the high-tension terminal 5. Numeral 7 denotes an ignition plug disposed on a cylinder of the internal combustion engine, numeral 7*a* denotes a plug gap disposed at one end of the ignition plug 7 in the cylinder, numeral 8 denotes a high-tension terminal of the ignition plug 7. The high-tension terminal 8 is disposed at the other end of the ignition plug 7, namely, at the high-tension voltage input end of the ignition plug 7. In FIG. 8, a conductor 9 is interposed between the high-tension terminal 5 and the high-tension terminal 8. The conductor 9 is made by cutting and machining a drawn brass bar material and has a plurality of small diameter portions 9*a* which are smaller than the shaft diameter of the conductor 9. The small diameter portions 9*a* are formed at a plurality of positions thereof including both ends as shown in FIG. 8. The conductor 9 is integrally molded within an adaptor 11 composed of an insulating resin with both the ends thereof exposed to the outside. The conductor 9 is securely fixed to the adaptor 11 by the small diameter portions 9*a* formed to the shaft portion thereof as for preventing the conductor 9 from falling from the adaptor 11. Springs 10*a* and 10*b* are attached to the small diameter portions 9*a* formed to both the ends of the conductor 9 so that the springs 10*a* and 10*b* come into contact with the high-tension terminal 5 and the high-tension terminal 8 in a slightly contracted state, respectively. The adaptor 11 is mechanically connected to the high-tension tower 6 of the ignition coil 1 by means of a first rubber cap 13. A falling-off preventing locking portion is formed to each of the high-tension tower 6, the adaptor 11 and first rubber cap 13 and an adhesive may be applied thereto if necessary to ensure their connection. A second rubber cap 14 is mechanically connected to the adaptor 11 on one side thereof near the ignition plug 7 (hereinafter referred to as the ignition plug side). A locking portion is also formed to the second rubber cap 14 with an adhesive applied thereto if necessary to ensure connection. The insulator of the plug 7 is inserted under pressure into the end of the second rubber cap 14 opposite to the adaptor 11. Numeral 12*a* denotes a plug hole having the ignition plug 7 disposed on the bottom thereof and numeral 12 denotes a plug hole wall. Numeral 15 denotes a cam shaft housing portion on the cylinder block of the internal combustion engine. The height of the cam shaft housing portion 15 corresponds to the length of the plug hole 12*a*.

Next, description will be made with reference to FIG. 9. Numeral 16 denotes a cylindrical adaptor made of an insulating resin. Only disposed between the high-tension terminal 5 of an ignition coil and the high-tension terminal 8 in the adaptor 16 is a long coil spring 17 in a slightly contracted state. Although the coil spring 17 is accommodated in the adaptor 16 without being mechanically fixed, since the diameter of the coil spring 17 at the central portion thereof is larger than the diameter 16*a* of the adaptor 16 at end portion thereof, the spring 17 does not fall from the end portion 16*a* of the adaptor 16 even if the ignition plug 7 is not mounted.

Next, functions of the respective components will be described. In many cases, one set of the ignition coil 1 is directly fixed on the cylinder head cover 3 on the ignition plug 7 with respect to one or two sets of the ignition plugs 7 of an internal combustion engine. On the other hand, although the length of the plug hole 12*a* and the configuration of the inlet of the plug hole are different for each engine in many cases depending upon the difference of the displacement or cubic capacity of the internal combustion engine and the mechanism of the cam shaft housing portion 15, the change of the plug hole 12*a* is coped with by changing the lengths of the adaptor 11 and conductor 9.

The first rubber cap 13 has a sealing portion in conformity with the configuration of the plug hole inlet to provide the rubber cap 13 with a function for preventing the invasion of water into the plug hole 12*a*, in addition to a function for connecting the ignition coil 1 to the adaptor 11 or the ignition coil 1 to the adaptor 16.

Therefore, the change of configuration of the plug hole inlet, for each internal combustion engine is coped with by the change of configuration of the first rubber cap 13.

The second rubber cap 14 is changed in accordance with the change of configuration of the insulator of the ignition plug 7 and the like.

In FIG. 9, the change of length of the plug hole 12*a* is coped with by changing the lengths of the adaptor 16 and the coil spring 17.

Next, operation and functions of the ignition apparatus arranged as described above will be described with reference to FIG. 8.

The ignition coil 1 generates a high-tension voltage in accordance with a primary current intermitted by a power transistor and control unit (not shown) connected to the extreme end of the harness 2. The high-tension voltage is output from the high-tension terminal 5 to the outside of the ignition coil 1, guided to the high-tension terminal 8 of the ignition plug 7 through the spring 10*a* and conductor 9 and the spring 10*b* and discharged at the plug gap 7*a* so as to fire a mixed gas in the cylinder of the internal combustion engine.

Note, igniting operation in FIG. 9 is effected similarly to the igniting operation effected in FIG. 8 but with only the difference that a high-tension voltage from the ignition coil 1 is fed to the high-tension terminal 8 of the ignition plug 7 through the coil spring 17.

Since the known ignition apparatuses for internal combustion engine are arranged as shown in FIG. 8 and FIG. 9, they have problems as described below.

In the known ignition apparatus shown in FIG. 8, when the adaptor 11 was made, the conductor 9 has to be molded by being inserted into a molding die by hand or a robot. Therefore, a fully-automatic molding cannot be carried out. Although the length of the plug hole 12*a* and the configuration of the plug hole inlet are often different for each internal combustion engine depending upon the difference of the displacement of the internal combustion engine and the mechanism of the cam shaft housing portion 15 as described above, since the change of length of the plug hole 12*a* is coped with by changing the lengths of the adaptor 11 and conductor 9, various dies having different lengths have to be prepared, thus it is difficult to reduce cost by increasing the number of parts molded by a die.

It is preferable to set a relatively high characteristic frequency to the adaptor 11 so that the adaptor 11 is not resonated by the vibration of an internal combustion engine. The characteristic frequency tends to be increased as the weight of the adaptor 1 is reduced.

However, since the adaptor 11 of FIG. 8 contains the conductor 9 composed on the bar material therein, the weight thereof is increased and the characteristic frequency thereof is relatively lowered accordingly. Therefore, when the characteristic frequency of the adaptor 11 shown in FIG. 8 approaches the vibration frequency of the internal combustion engine, there is a possibility that the adaptor 11 is greatly vibrated by the effect of the vibration of the internal combustion engine or the resin is broken by a large force applied to a holding portion.

On the other hand, according to the known ignition apparatus shown in FIG. 9, since the adaptor 16 had a cylindrical hollow structure and further the coil spring 17 is employed as the conductor, the adaptor 16 has a relatively light weight. However, the ignition apparatus shown in FIG. 9 has a problem that the coil spring 17 is resonated and the aforesaid problems could not be solved by the apparatus.

Namely, since the conductor is composed of the coil spring 17 in FIG. 9, when the plug hole 12*a* is long, the number of turns of the coil spring is greatly increased. In general, when forcible vibration is applied to a coil spring, a resonance phenomenon arises. The characteristic frequency f of the coil has a relationship $f \propto 1/n$ (namely, f is in proportion to n) between the characteristic frequency f and the number n of turns of the coil when the wire diameter of the coil spring and the diameter of the coil are given. When the number of turns of the coil is small as the case of the springs 10*a* and 10*b* of the known ignition apparatus of FIG. 8, since the characteristic frequency of resonance is very high, there is no possibility of resonance caused by the vibration of an internal combustion engine. However, when the number of turns is large as the case of the known ignition apparatus of FIG. 9, the characteristic frequency of resonance is lowered to the level of the vibration frequency of an internal combustion engine. More specifically, since the vibration frequency of the coil spring 17 approximately coincides with the vibration frequency of the internal combustion engine in a certain rotation range of the internal combustion engine, the coil spring 17 greatly vibrates in the axial direction of the winding thereof. When the internal combustion engine has a large amount of vibration acceleration at the time, jumping is caused at the contact portion of the high-tension terminal 5 or the high-tension terminal 8, thus an electrical contact state can not be securely obtained.

The jumping produces worn powder which acts as a high-tension voltage leaking path at the contact portion, and causes spark discharge between the high-tension terminal which is not in contact and an end of the coil spring when the jumping arises at a timing at which a high-tension voltage is generated (the ignition timing of the internal combustion engine) at the ignition coil 1. As a result, the capability of the ignition plug 7 for firing a mixed gas at the plug gap 7*a* is lowered as well as the spark discharge acts as a source for producing firing noise, thus there is a possibility that the malfunction of various devices surrounding the internal combustion engine may be caused by it.

In general, the ignition apparatus is supplied from an ignition apparatus manufacturer to an internal combustion engine manufacturer in many cases in the form of the ignition apparatus in which an ignition coil is assembled to an adaptor assembly. Here, the adaptor assembly includes the conductor, coil spring, adaptor, first rubber cap 13 and second rubber cap 14. Then, the ignition apparatus is assembled to an internal combustion engine main body, to which an ignition plug is already mounted, on a manufacturing line of the internal combustion engine manufacturer.

That is, the adaptor assembly is independently handled on a manufacturing line differently from the manufacturing line of the ignition coil in the ignition apparatus manufacturer. Then, an ignition coil is assembled to an adaptor assembly in correspondence with each target internal combustion engine in the final process of the ignition apparatus manufacturing line of the ignition apparatus manufacturer.

In the ignition apparatus shown in FIG. 8, however, when the adaptor assembly composed of the conductor 9, coil springs 10*a*, 10*b*, adaptor 11, first rubber cap 13 and second rubber cap 14 is handled in a state of a single body, there is a possibility that the coil springs 10*a*, 10*b* fell off from an end of the adaptor 11. To cope with this problem, since whether the coil springs 10*a*, 10*b* fell off or not had to be confirmed prior to an assembly process for assembling the adaptor assembly to the ignition coil, there is a problem that a job for confirmation is time-consuming and time and cost are further increased accordingly. Otherwise, the assembly of the coil springs 10*a*, 10*b* had to be effected at the same time when the adaptor assembly and the ignition coil are assembled or when the adaptor assembly, the ignition coil and the ignition plug are assembled.

In the ignition apparatus shown in FIG. 9, when the adaptor assembly is handled in a state of a single body, there is a possibility that the coil spring 17 falls off and dropped from the adaptor 16 through the high-tension tower 6. As a result, since the adaptor assembly cannot be handled as the single body in FIG. 9, the assembly is handled in a state that the adaptor 16 is provided with the first rubber cap 13 and the second rubber cap 14, and the 17 coil spring 17 has to be assembled simultaneously with the assembly of the adaptor assembly and the ignition coil or the assembly of the adaptor assembly, the ignition coil and the ignition plug.

However, since a relationship suitable to each internal combustion engine must be established between an adaptor assembly and a coil spring, various combinations of many types of adaptor assemblies and coil springs must be made for respective types of internal combustion engines. Therefore, when a coil spring is mounted to adaptor assembly in a final process in which an ignition coil is assembled, caution must be taken for such a mistake that a different type of or unsuitable coil spring is mounted to an adaptor assembly, by which efficiency of a manufacturing process is deteriorated and processability is lowered.

Accordingly, it is preferable that when the conductor 9, coil spring 17, adaptors 11 and 16, first rubber cap 13 and second rubber cap 14 are assembled once as an adaptor assembly, the adaptor assembly can be handled as a single body without causing the falling-off of any parts.

SUMMARY OF THE INVENTION

An object of the present invention made to solve the aforesaid problems is to provide an electric connection member having high mechanical and electrical reliability to vibration and further excellent in processability at low cost.

An object of the present invention is to provide an ignition apparatus for internal combustion engine in which parts do not fall off even if an adaptor assembly is hangled as a single body.

An object of the present invention is to provide an ignition apparatus for internal combustion engine which can be made in manufacturing processes whose sequence has a high degree of freedom.

An object of the present invention is to provide an ignition apparatus for internal combustion engine capable of suppressing the wear of contact portions.

An object of the present invention is to provide an ignition apparatus for internal combustion engine which causes less voltage leakage.

An object of the present invention is to provide an ignition apparatus for internal combustion engine having high mechanical and electrical reliability to vibration of an internal combustion engine and further excellent in processability at low cost.

An object of the present invention is to provide a method of manufacturing an ignition apparatus for internal combustion engine having high mechanical and electrical reliability to vibration of an internal combustion engine and further excellent in processability at low cost.

Further, an object or the present invention is to provide a method of manufacturing an ignition apparatus for internal combustion engine which has manufacturing processes whose sequence has a high degree of freedom.

With the above objects in view, the electric connection member of the present invention comprises cylindrical adaptor means defining a cavity extending therethrough and disposed between devices to be electrically connected while insulated therefrom; and conductor means slidably inserted into the cavity of the adaptor means for electrically connecting between the devices, wherein the conductor means is composed of a coil spring and a contact member with a predetermined shape and in electric contact with the coil spring.

The present invention also resides in an ignition apparatus for internal combustion engine using electric connection member which comprises an ignition coil for generating high-tension voltage at a ignition timing of an internal combustion engine; an ignition plug for igniting the internal combustion engine by the high-tension voltage; and an electric connection member for electrically connecting the ignition coil to the ignition plug, wherein the electric connection member comprises: cylindrical adaptor means defining a cavity extending therethrough and mechanically connected between the ignition coil and the ignition plug while electrically insulated thereagainst; and conductor means slidably inserted into the cavity of the adaptor means for electrically connecting between the ignition coil and the ignition plug, and the conductor means is composed of a coil spring and a contact member with a predetermined shape and in electric contact with the coil spring.

The coil spring and the contact member of the conductor means may be integrated with each other. Alternatively, the coil spring and the contact member of the conductor means may be composed of separate bodies. Also, the adaptor means, the coil spring and the contact member may have first locking means for preventing the coil spring and the contact member from falling from the adaptor means.

Further, the present invention also resides in a manufacturing method of the ignition apparatus for internal combustion engine using electric connection member in which an ignition coil and an ignition plug are connected to each other through a cylindrical adaptor means having a conductor mean disposed in a cavity defined within the adaptor means and composed of a coil spring and a contact member with a predetermined shape in electric contact with the coil spring. The manufacturing method comprises the steps of: providing first locking means to the adaptor means, the coil spring and the contact member for preventing the coil spring and the contact member from falling off from the adaptor means; inserting the coil spring into the cavity of the adaptor means so that the first locking means of the coil spring is engaged with the first locking means of the adaptor means; inserting the contact member into the cavity of the adaptor means so that the first locking means of the contact member is engaged with the first locking means of the adaptor means; mounting the ignition coil to an end of the adaptor means and connecting the ignition coil to the conductor means; and mounting the ignition plug to the other end of the adaptor means and connecting the ignition plug to the conductor means.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF PREFERRED EMBODIMENTS

First Embodiment

Figure 1:
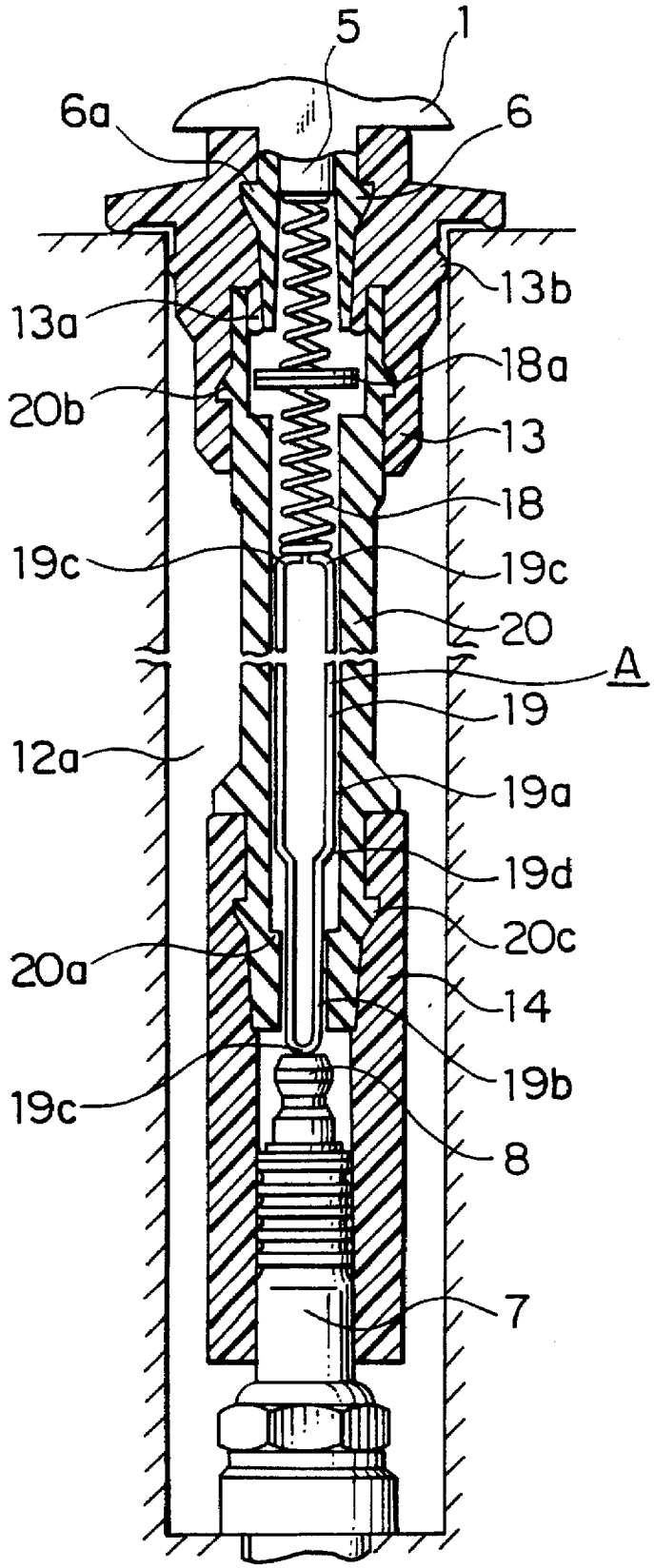
FIG. 1 is a cross sectional view showing the electric connection member of a first embodiment of the present invention.
Figure 8:
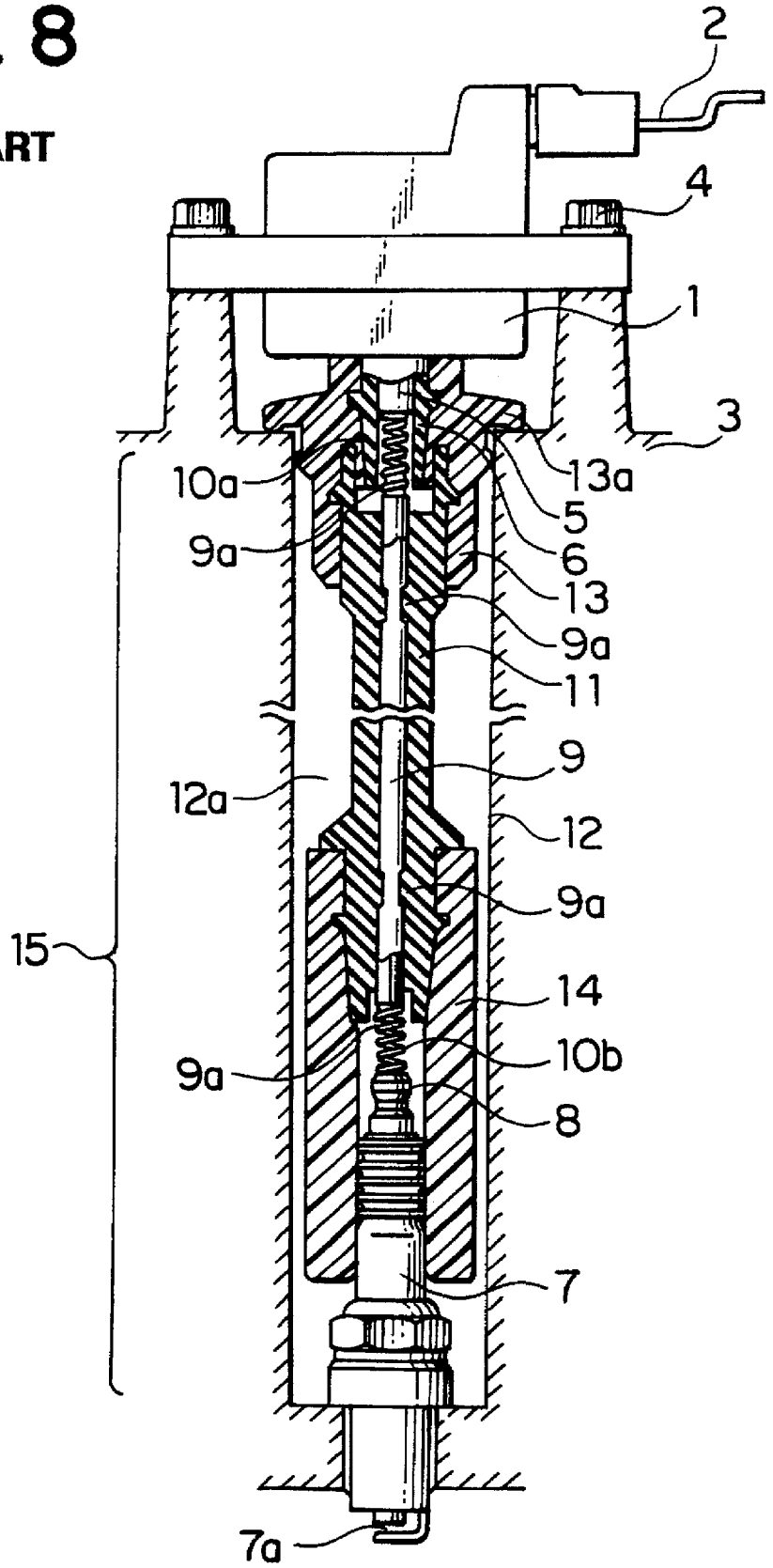
FIG. 8 PRIOR ART
FIG. 8 is a cross sectional view showing a known ignition apparatus.
Figure 9:
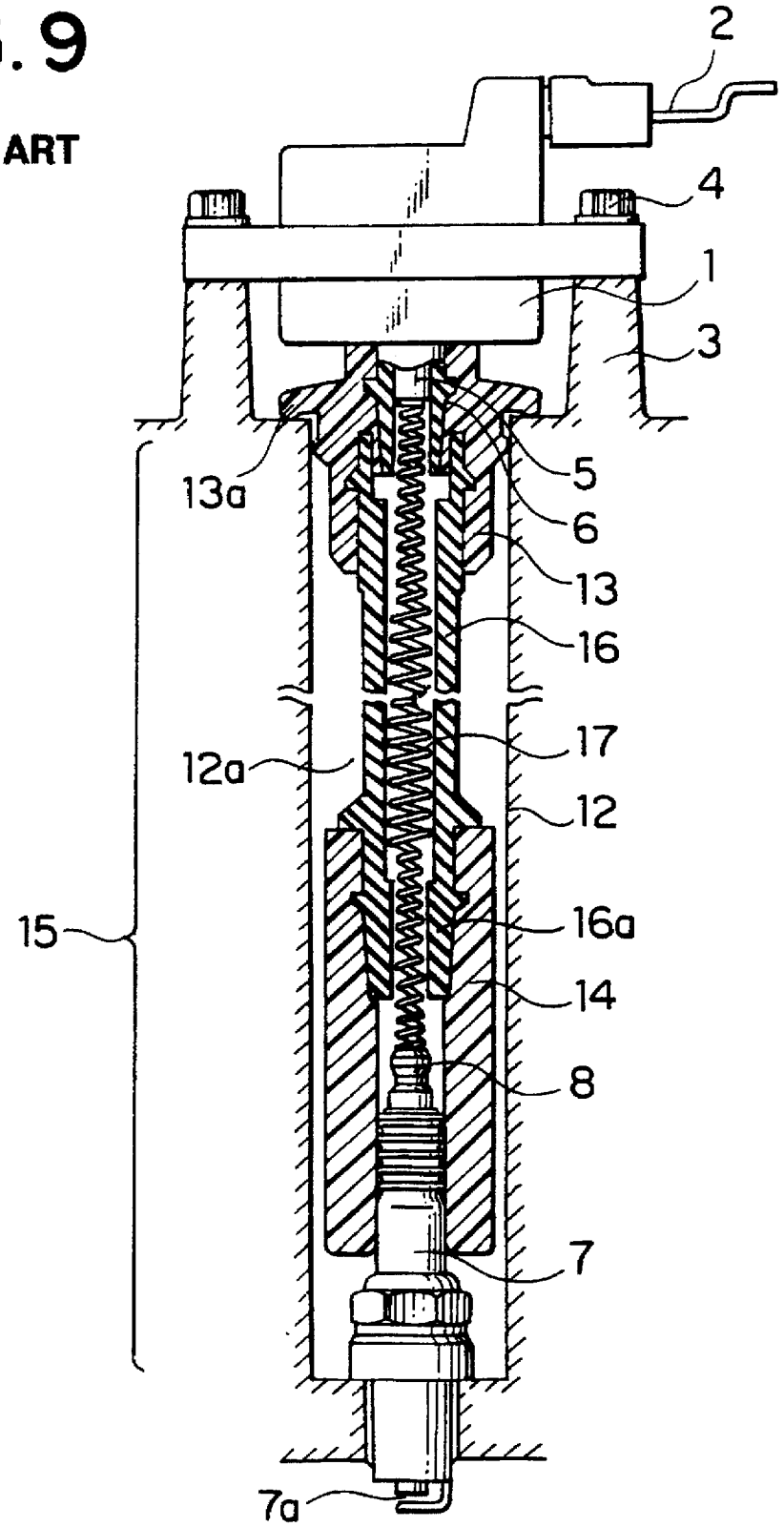
FIG. 9 PRIOR ART
FIG. 9 is a cross sectional view showing another known ignition apparatus.

FIG. 1 is a cross sectional view of an electric connection member of an embodiment 1 of the present invention and shows an example that the electric connection member is applied to an ignition apparatus. The same reference numerals as used in FIG. 8 and FIG. 9 are used in FIG. 1 to designate the same or corresponding parts.

In FIG. 1, reference numeral 1 designates an ignition coil, numeral 5 denotes a high-tension terminal for taking out a high-tension voltage to the outside which is generated at the ignition coil 1 at an ignition timing of an internal combustion engine, and numeral 6 denotes a high-tension tower disposed around the high-tension terminal 5. Numeral 7 denotes an ignition plug disposed on a cylinder of the internal combustion engine, numeral 8 denotes a high-tension terminal at the high-tension voltage input end of the ignition plug 7. A conductor means A is interposed between the high-tension terminal 5 and the high-tension terminal 8 to electrically connect between them. Numeral 20 is an adaptor made for example of an insulating resin.

In FIG. 1, the conductor means A is composed of a coil spring 18 having a large diameter portion 18*l* and a contact member 19 abutted against an end of the coil spring 18.

The coil spring 18 is composed of a piano wire having conductivity and elasticity with a diameter of 0.4–0.6 mm.

The contact member 19 is composed of a wire-shaped conductor material having conductivity, elasticity and corrosion resistance with a diameter of 0.5–2 mm and formed to a predetermined configuration by being bent to a slender and approxiamate U-shape in conformity with the inside wall configuration of the cavity of an adaptor 20 as shown in FIG. 1. The contact member 19 has a large diameter portion (wide portion) 19*a* and a small diameter portion (narrow portion) 19*b* as shown in FIG. 1. A stainless steel wire, an aluminum rod, a piano wire and the like, for example, may be used as the wire-shaped conductor material. When phosphor bronze is used as the contact member 19, it can be easily soldered in addition to the above characteristics.

Note, numeral 19*c* denotes contact portions where the contact member 19 is in contact with the coil spring 18 or the high-tension terminal 8. The contact surfaces of the contact member 19 and the high-tension terminal 8 which are in contact with each other are formed to a flat shape to achieve a stabilized contact state.

The contact member 19 is arranged such that the single wire-shaped conductor material is bent to form a projected portion 19*d* at the lower end thereof as shown in the drawing. The contact member which has the projected portion 19*d* has an elastic force in the direction normal with respect to that in which the contact memeber 19 is inserted, that is, it has an elastic force in a direction normal with respect to a direction from the top to the bottom of the drawing.

The conductor means A composed of the coil spring 18 and the contact member 19 as described above is slidably inserted into the cylindrical adaptor 20 composed of an insulation material such as an insulation resin. The coil spring 18 comes into contact with the high-tension terminal 5 and the high-tension terminal 8 in a state that the coil spring 18 is slightly contracted. The adaptor 20 is connected to the high-tension tower 6 of the ignition coil 1 through a first rubber cap 13 and falling-off prevention locking portions 6*l*, 20*b* and 13*b* are formed to the high-tension tower 6, the adaptor 20 and the first rubber cap 13, respectively. The first rubber cap 13 is for example of insulated silicone rubber which has an elasticity. If necessary, an adhesive is applied to the portions to ensure their connection. A second rubber cap 14 composed of silicone rubber is also connected mechanically and securely to the adaptor 20 on the side near the ignition plug 7 (hereinafter referred to as the ignition plug side) through a locking portion 20*c* formed to the adaptor 20. In this case, an adhesive is also applied to the portion is necessary to ensure the their connection. The end of the second rubber cap 14 on the side opposite to the adaptor 20 is arranged to enable it to be connected to the ignition plug 7. The insulator of the ignition plug 7 is attached to the second rubber cap 14 by being inserted under pressure. The first rubber cap 13, adaptor 20 and second rubber cap 14 constitute an adaptor means.

The electric connection member is composed of the adaptor means, coil spring 18 and contact member 19.

A manufacturing method will be described. The contact member 19 is inserted into the adaptor 20 provided with the second rubber cap 14 from the side where the ignition coil 1 is to be provided (hereinafter referred to as the ignition coil side). Since the maximum width of the large diameter portion 19*a* of the contact member 19 is larger than the small diameter portion 20*a* of the adaptor 20 as shown in FIG. 1, the contact member 19 does not fall from the opening of the adaptor 20 on the side thereof where the ignition plug 7 is to be connected. Here, the small diameter portion 20*a* is provided to one of the end portions of the adaptor 20 which is to be connected to the ignition plug 7. Next, when the coil spring 18 is inserted into the adaptor 20, so that the contact member 19 comes into electric contact with the coil spring 18. The high-tension tower 6 and the first rubber cap 13 are disposed to the adaptor 20, by which the coil spring 18 can be prevented from falling from the adaptor 20. Next, the ignition coil 1 is mounted to an end of the adaptor 20. Finally, the ignition plug 7 is mounted to the other end of the adaptor 20. Note, the second rubber cap 14 need not be mounted from the beginning but may be mounted later.

The manufacturing method is not limited to the aforesaid one but may be arranged as described below. First, the first and second rubber caps 13 and 14 are mounted to the adaptor 20. Next, the contact member 19 is inserted into the adaptor 20 through the first rubber cap 13. Since the first rubber cap 13 has elasticity, the coil spring 18 is inserted under pressure into the adaptor 20 by using the elasticity. Inserted once, the coil spring 18 does not fall off from the adaptor 20 by being obstructed by the first rubber cap 13 because the large diameter portion 18*a* of the coil spring 18 is larger than the inside diameter of the cylinder portion 13*a* of the first rubber cap 13. Finally, the ignition coil 1 and the ignition plug 7 are mounted to the adaptor 20.

In the electric connection member arranged as described above, even if the electric connection member is handled as a single body, the parts constituting it do not fall out.

That is, the maximum width of the large diameter portion 19*a* of the contact member 19 is larger than the small diameter portion 20*a* of the adaptor 20 as shown in FIG. 1, whereby the contact member 19 does not fall from the opening of the adaptor 20 on the side where the ignition plug 7 is to be connected.

Further, the maximum diameter of the large diameter portion 18*a* of the coil spring 18 is larger than the cylinder portion 13*a* of the rubber cap 13, whereby the coil spring 18 does not fall from the opening of the adaptor 20 on the side where the ignition coil 1 is to be connected.

Note, the cylinder portion 13*a* and the small diameter portion 20*a* are first locking means provided with an adaptor means, the large diameter portion 18*a* is a first locking means provided with the coil spring 18 and the large diameter portion 19*a* is a first locking means provided with the contact member 19.

Further, the electric connection member constitutes an ignition apparatus by being connected to the ignition coil 1. At the time, the first rubber cap 13 at one end of the adaptor means is locked to the high-tension tower 6 of the ignition coil 1 as well as the high-tension terminal 5 is electrically connected to one end of the coil spring 18 by coming into contact therewith by being pressed thereagainst by an elastic force.

The weight of the ignition apparatus is reduced because the adaptor 20 has a cavity as well as the conductor means A is composed of the coil spring 18 and the contact member 19 composed of the wire-shaped conductor.

The number of turns of the coil spring 18 is very small as compared with that of the coil spring 17 shown in FIG. 9.

Consequently, the characteristic frequency of the ignition apparatus is very large as compared with the vibration frequency of vibration generated at the maximum engine speed of the internal combustion engine, whereby the ignition apparatus is not broken by being resonated by the vibration of the internal combustion engine.

Since the characteristic frequency of the coil spring 18 can be set to a large value, the coil spring 18 does not jump.

The plug hole length 15 of the internal combustion engine can be changed by changing the entire length of the adaptor 20 and the entire length of the contact member 19. Since the length of the coil spring 18 need not be changed, it can be applicable to various types of ignition apparatuses, by which the number of production of the coil springs 18 is increased and the cost thereof is reduced accordingly.

Since the conductor means A need not be insert molded in the adaptor, a cost can be reduced by deleting a molding step in which the number of mold dies are necessary as described above, and enabling to employ full automatical manufacturing process.

Further, since the contact member 19 has an elastic force in a direction normal to the direction toward which it is inserted, even if vibration is applied thereto in right and left directions in the drawing, the vibration of the contact member 19 can be suppressed.

SECOND EMBODIMENT

Figure 2:
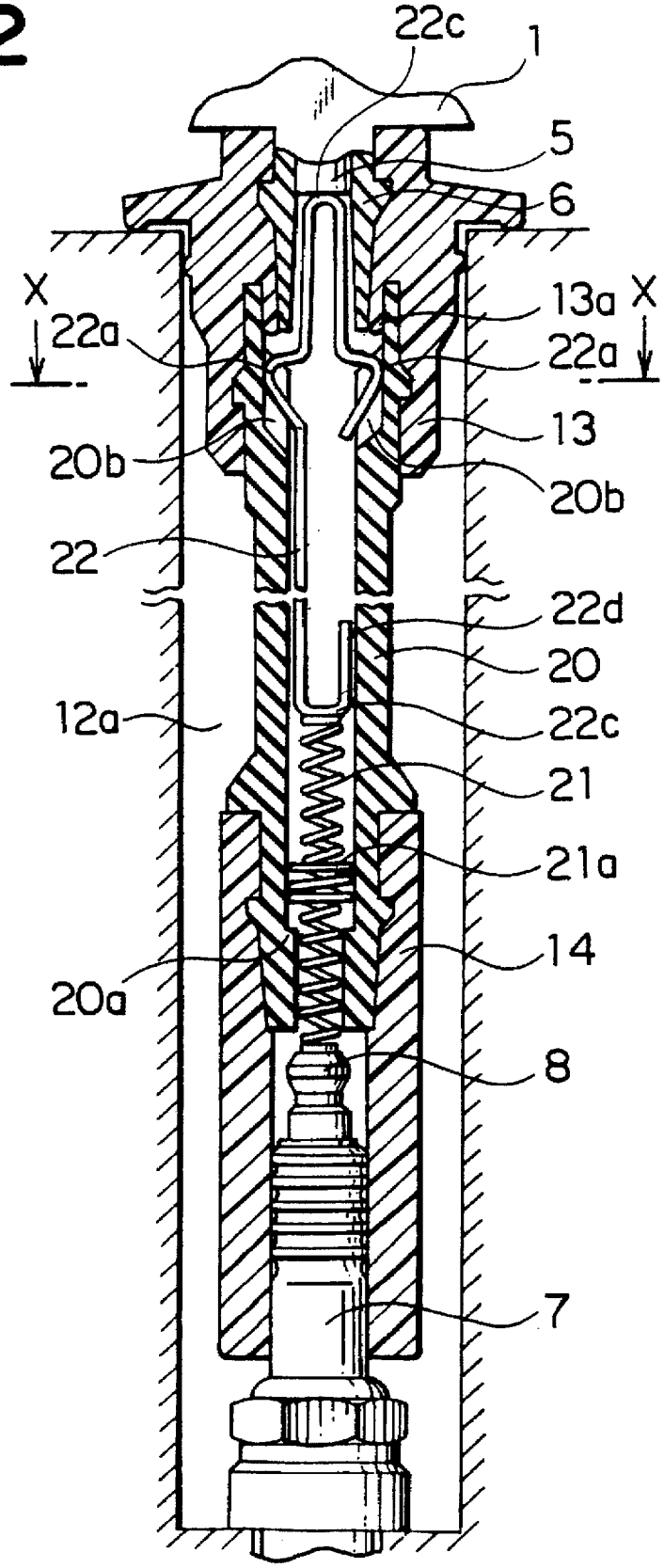
FIG. 2 is a cross sectional view showing the electric connection member of a second embodiment of the present invention.

FIG. 2 is a cross sectional view of the electric connection member according to the embodiment 2 of the present invention and shows an example that the electric connection member is applied to an ignition apparatus. In FIG. 2, the same reference numerals as used in FIG. 1 are used to designate the same or corresponding parts.

The electric connection member shown in FIG. 2 has basically the same structure as that illustrated in FIG. 1 but is different in several points. In FIG. 2, the position of a coil spring is replaced with the position of a contact member as compared with FIG. 1. Numeral 21 denotes the coil spring having a large diameter portion 21*a* which is smaller than the inside diameter of the cylinder portion 13*a* of a first rubber cap 13 and the inside diameter of an adaptor 20 as well as which is larger than the inside diameter of the small diameter portion 20*a* of the adaptor 20. Numeral 22 denotes a contact member composed of the same wire-shaped conductor as used in the aforesaid contact member 19. The contact member 22 is a substantially C-shaped member. A pair of tapered portions 22*a* which have a taper directing from the lower side to the upper side in the drawing and serves as a first locking means is provided to the contact member 22 as a part thereof. One of the tapered portions 22*a* is formed at one of the legs of the "C". The other is formed to one portion of the "C" which is not centrally located but slightly biased towards the upper side in the drawing so as to position at the same height as that of the one tapered portion 22*a*. The maximum width of the tapered portions 22*a* is larger than the inside diameter of the cylinder portion 13*a* as the first locking means of the first rubber cap 13. Note, the tapered portions 22*a* have an elastic force in the direction normal from one toward which the contact member 22 is inserted. That is, the tapered portions 22*a* have an elastic force or flexibility in the direction normal with respect to a direction from the top to the bottom of the drawing. Numeral 22*c* denotes contact portions where the contact member 22 is in contact with a high-tension terminal 5 and the coil spring 21, respectively, and they are formed to shapes through which they can easily come into contact with each other. Numeral 22*d* denotes the other leg of the "C" which is therefore an end portion of the contact member 22. The end portion 22*d* has an elastic force in a direction normal to the direction toward which the contact member 22 is inserted.

Since the second embodiment is arranged as described above, it has an advantage that it can be easily manufactured, in addition to the advantages of the first embodiment. Since the tapered portions 22*a* of the contact member 22 have the elastic force in the direction normal to the inserting direction thereof the arrangement shown in FIG. 2, the contact member 22 can be mounted by being inserted under pressure from the mounting hole side of the high-tension tower 6 of the first rubber cap 13 even after the first rubber cap 13 is mounted to the adaptor 20. The tapered portions 22*a* are restored to the state of FIG. 2 after the contact member 22 is inserted. Therefore, according to this embodiment, a manufacturing sequence is not limited and freedom of manufacturing processes is increased.

Since the tapered portions 22*a* have the elastic force in the direction vertical to the inserting direction, even if vibration is applied in the right and left directions in the drawing, the vibration of the contact member can be suppressed.

Since the end portion 22*d* of the contact member 22 also has the elastic force in the direction normal to the inserting direction, the vibration of the contact member 22 in the right and left directions in the drawings is suppressed at the two points, namely, the upper tapered portions 22*a* and the lower end portion 22*d* in the drawing, thus the vibration of the contact member 22 can be more securely suppressed.

Figure 3:
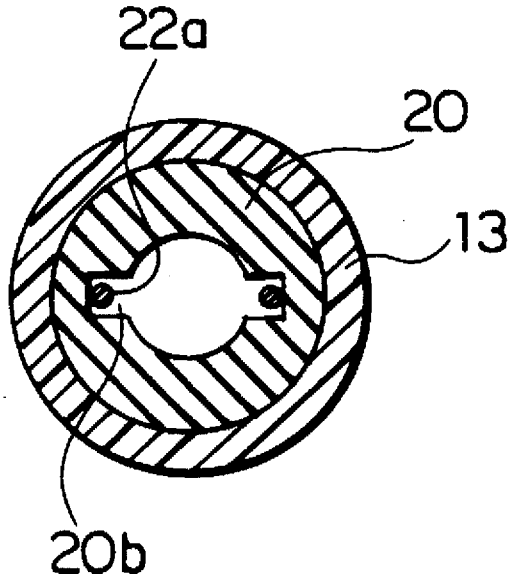
FIG. 3 is a cross sectional view taken along the like X—X of FIG. 2.

The second embodiment has an advantage that the rotation of the contact member 22 can be prevented and the wear thereof can prevented accordingly, in addition to the advantages of the first embodiment. The reason is as follows. Numeral 20*b* denotes groove portions defined to the inside wall of the adaptor 20 in an axial direction thereof. FIG. 3 shows a cross sectional view taken along the line X—X of FIG. 2. As shown in FIG. 2 and FIG. 3, the contact member 22 is inserted into the adaptor 20 so that the tapered portions 22*a* are guided along the groove portions 20*b* so as to locate along the groove portions 20*b*. Therefore, even if the contact member 22 tends to be rotated by vibration, the rotation is prevented by the groove portions 20*b*.

Note,. the groove portions 20*b* are a second locking means formed to an adaptor means to prevent the rotation of the-contact member 22. Further, the tapered portions 22*a* are a second locking means provided with the contact member 22 to prevent the rotation of the contact means.

That is, the tapered portions 22*a* serve as both the first and second locking means provided with the contact member 22 and constitute a falling-off and rotation perverting portion.

Note, the second locking means for preventing the rotation of the contact member is easily applicable to the first embodiment. That is, it suffices only to form the configuration of the opening of the adaptor 20 on the ignition plug 7 side to a configuration other than a circle and define the groove portions 20*b* on the inside wall of the adaptor 20 as shown in FIG. 3 so that the small diameter portion 19*b* of the contact member 19 is accommodated in the groove portion 20*b*. Otherwise, the opening may be formed to an ellipse to regulate the rotation of the small diameter portion 19*b*.

THIRD EMBODIMENT

Figure 4:
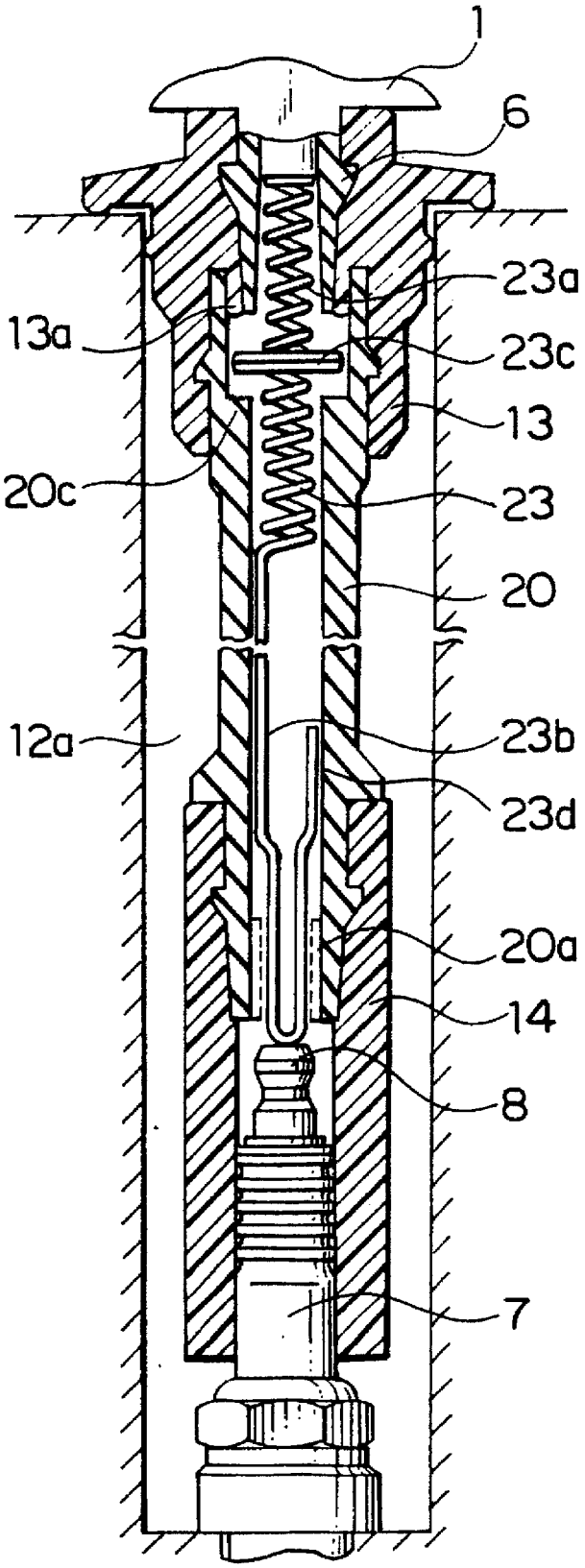
FIG. 4 is a cross sectional view showing the electric connection member of a third embodiment of the present invention.

A third embodiment of the present invention included an electric connection member in which a coil spring is integrated with a contact member. FIG. 4 is a cross sectional view of the electric connection member of the arrangement according to the third embodiment and shows an example that the electric connection member is applied to an ignition apparatus. The same reference numerals as used in FIG. 1 or FIG. 2 are used in FIG. 4 to denote the same or corresponding parts. In FIG. 4, numeral 23 denotes a conductor composed of a coil spring and a conductor member which are integrated with each other. The conductor 23 includes a spring portion 23*a* and a contact portion 23*b*. The adaptor 20 has a step 20*c* which is formed to the inside wall thereof. The step 20C divides the inside of the adaptor 20 into a smaller diameter portion and a larger diameter portion therefrom. The smaller diameter portion is located lower than the larger diameter portion in the drawing.

The conductor 23 has a large diameter portion 23*c* as a first locking means and the diameter of the portion 23*c* is larger than the inside diameter of a cylinder portion 13*a* and the inside diameter of the smaller diameter portion of the adaptor 20 which is formed by the step 20*c*. The cylinder portion 13*a* and the step 20*c* constitute a first locking means which acts to prevent the conductor 23 from falling from any opening of an adaptor 20 on the ignition coil side and ignition plug side thereof.

In FIG. 4, the small diameter portion 20*a*, which is described in the second embodiment shown in FIG. 2, is shown by a dotted line. That is, since the small diameter portion 20*a* need not have a function as a falling-off preventing portion in the third embodiment, it may be omitted. Also, the rotation of the conductor 23 may be prevented by defining the aforesaid groove portions or the like in place of the small diameter portion 20*a*. The third embodiment may be manufactured by any of the methods described in the aforesaid first embodiment.

Therefore, according to the third embodiment, since the conductor 23 composed of a coil spring and a conductor member which are integrated with each other is used, there is obtained an advantage that the arrangement can be simplified by reducing the number of parts, whereby a cost reduction can be achieved, in addition to the advantages of the aforesaid embodiments.

FOURTH EMBODIMENT

Figure 5:
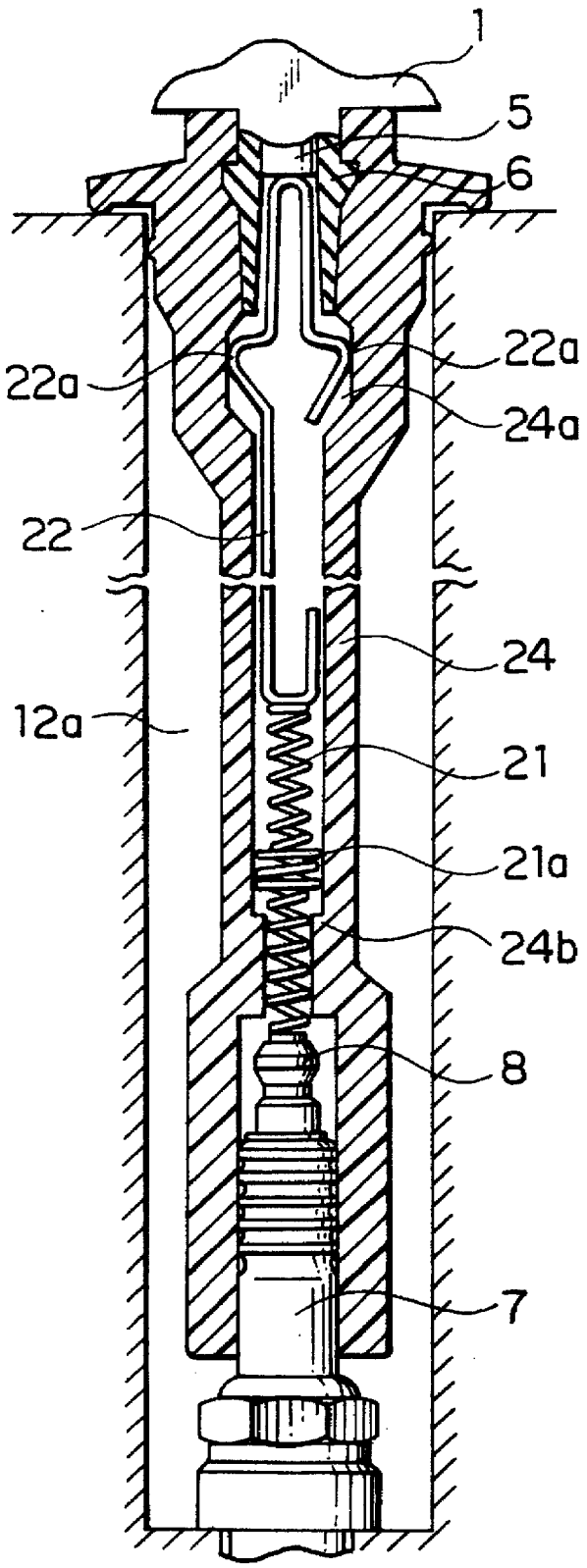
FIG. 5 is a cross sectional view showing the electric connection member of a fourth embodiment of the present invention.

A fourth embodiment uses an electric connection member in which an adaptor is integrated with first and second rubber caps. FIG. 5 is a cross sectional view of the electric connection member of the fourth embodiment and shows an example that the electric connection member is applied to an ignition apparatus. In FIG. 4, the same or corresponding parts as those mentioned above are denoted by the same numerals. In the drawing, numeral 24 denotes an adaptor as an adaptor means which is composed of the adaptor and the first and second rubber caps molded as an integral body. The adaptor 24 is for example made of silicone rubber formed to a cylindrical shape. Further, a chamber or space 24*a* shown in FIG. 5 is formed simultaneously with the molding of the adaptor 24. A manufacturing method of the adaptor 24 is arranged such that a metallic mold core formed to a the inside cavity in the adaptor 24 is placed in a mold die and silicone rubber is poured into the space between the die and the core. When the silicone rubber is solidified to a certain extent, the silicone rubber is taken out from the die, and finally, the core is taken out from the silicone rubber by using the elastic force of the silicone rubber.

The electric connection member arranged as described above is manufactured as described below. A coil spring 21 is inserted from the opening of the adaptor 24 on an ignition coil side. Since the diameter of the large diameter portion 21*a* of the coil spring 21 is larger than that of the small diameter portion 24*b* of the adaptor 24, the coil spring 21 does not fall from the opening of the adaptor 24 on an ignition plug side. Next, a contact member 22 is in inserted under pressure from the opening of the adaptor 24 on the ignition coil side. Since the tapered portion 22*a* of the contact member 22 has elasticity in a direction normal to the inserting direction thereof, when the contact member 22 is inserted from the opening of the adaptor 24 on the ignition coil 1 side, it pass through the opening with the maximum width of the tapered portion 22*a* contracted and thereafter the tapered portion 22*a* is restored to its original maximum width in the chamber 24*a*.

consequently, the coil spring 21 and the contact member 22 do not fall off from the openings of the adaptor 24 even if the electric connection member is handled in a state a single body.

Further, since the adaptor means is arranged to have an integral structure, it can be easily made as well as a cost reduction can be achieved.

Note, the electric connection member is arranged such that an end thereof can be connected to the ignition coil 1 and the other end thereof can be connected to the ignition plug 7, so that the electric connection member is electrically connected to the high-tension terminal 5 of the ignition coil 1 to constitute an ignition apparatus, similarly to the above embodiments.

FIFTH EMBODIMENT

Figure 6:
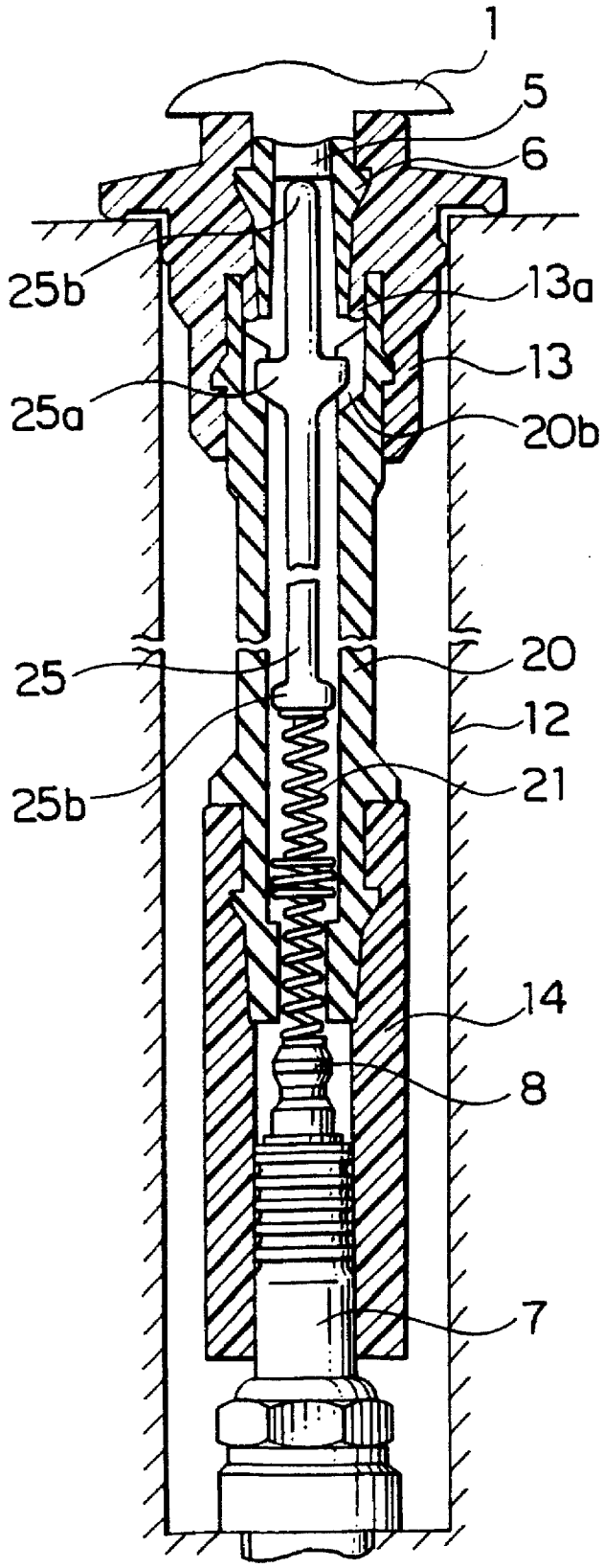
FIG. 6 is a cross sectional view showing a main portion of the arrangement of a fifth embodiment of the present invention.

In a fifth embodiment, a contact member is composed of a sheet-shaped conductor. FIG. 6 is a cross sectional view showing the electric connection member of the of the embodiment 5, wherein the same or corresponding parts as those mentioned above are denoted by the same reference numerals. In FIG. 6, numeral 25 denotes a slender sheet-shaped or plate-shaped contact member made by stamping or pressing a raw sheet material or a plate material having conductivity, the contact member being obtained by stamping a raw sheet material or pressing a plate material. The raw sheet material and the plate material is for example composed of aluminum, brass, iron or the like with a thickness of 0.5–3 mm. Numeral 25*a* denotes a falling-off and rotation preventing portion which serves as a first locking means for preventing the falling-off of the contact member 25 in cooperation with the a cylinder portion 13*a* and serves as a second locking means for preventing the rotation of the contact member 25 in cooperation with groove portions 20*b*.

The contact portion 25*b* of the contact member 25 is formed to a configuration which enables the contact member 25 to easily come into contact with a high-tension terminal 5 and a coil spring 21. In this embodiment, any of the manufacturing methods described in the above first embodiment may be used.

As described above, since the contact member 25 is a stamped or pressed product, it can be formed to a relatively optional configuration. Thus, when a thin sheet or plate is used and a configuration is devised, the contact member 25 can achieve the same advantages as those of the aforesaid embodiments with a weight smaller than that of the rod conductor 9 as shown in FIG. 8, although the weight is not so light as that of the wire-shaped conductor.

Figure 7A:
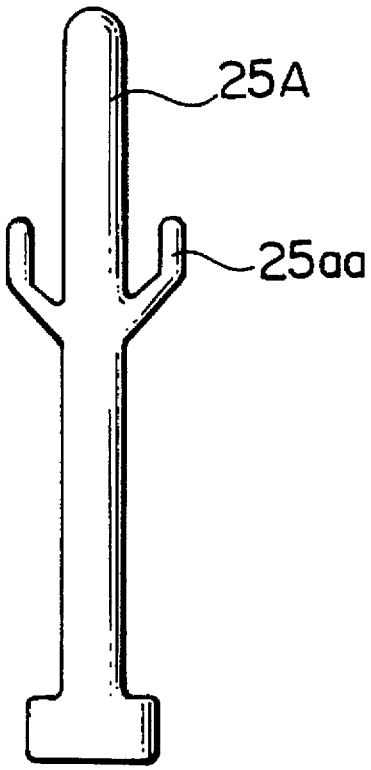
FIG. 7A is a view showing the arrangement of another example of a contact member of the fifth embodiment of the present invention.
Figure 7B:
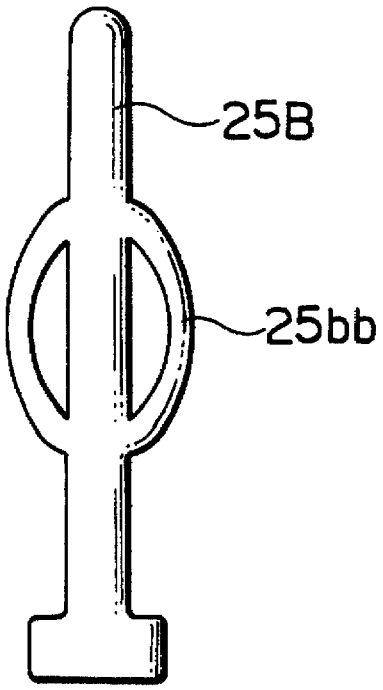
FIG. 7B is a view showing the arrangement of another example of a contact member of the fifth embodiment of the present invention.

Further, the contact member may be formed to ones 25A and 25B having configurations shown in FIG. 7A or FIG. 7B. The contact member 25A and 25B have spring portions or tapered portions 25*aa* and 25*bb*, respectively. At the time, the spring portions or tapered portions 25*aa* and 25*bb* serves as the falling-off and rotation preventing means, since they have elasticity in a direction normal to the inserting direction.

Therefore, the contact member can be inserted into an adaptor even after a first rubber cap is mounted to the adaptor, thus the fifth embodiment has freedom of manufacture like the second embodiment.

Incidentally, when the contact member 25 is made by stamping or pressing, acute edges or burrs are formed a long the circumference of the contact member 25. The burrs cause concentration of electric field and a high-tension voltage generated by the concentration of electric field is liable to leak to a plug hole wall 12 through the adaptor 20.

Therefore, it is preferable to form the contact member 25 to a predetermined configuration by stamping or pressing as well as adding a process for breaking and rounding the burrs to a forward-feeding pressing process, whereby the leakage of a high-tension voltage can be prevented.

SIXTH EMBODIMENT

Although various types of embodiments are shown above, it is needless to say that the features of the respective embodiments can be optionally combined based on the spirit of the present invention and such combinations can be embodied as the embodiments of the present invention.

As has been described above, according to the electric connection member of the present invention, the ignition coil 1 at an end of the adaptor means is electrically connected to the ignition plug 7 at the other end of the adaptor means by the conductor composed of the coil spring, which is slidably inserted into the cylindrical adapter means, and the contact member having the predetermined configuration abutted against the coil spring. Thus, there can be obtained the electric connection member which exhibits high mechanical and electrical reliability to vibration and further is excellent in processability with a low cost.

According to the electric connection member of the third embodiment of the present invention, since the coil spring is integrated with the contact member, the arrangement of the electric connection member can be simplified.

According to the electric connection member of the present invention, the first locking means provided with the adaptor means, the coil spring and the contact member prevent the coil spring and the contact member from falling off from the adaptor means even if the electric connection member is handled as a single body.

According to the electric connection member of the present invention, since the first locking means provided with the contact member has elasticity in a direction normal to the direction toward which the contact member is inserted, even if the inside diameter of the first locking means provided with the adaptor means is smaller than the maximum width of the contact member, the contact member can be inserted under pressure into the adaptor means.

According to the electric connection member of the second and fifth embodiments of the present invention, the rotation of the contact member can be prevented by the second locking means provided with the adaptor means and the contact member, whereby the wear of a contact portion can be prevented.

According to the electric connection member of the present invention, since the contact member is composed of the wire-shaped conductor formed to the predetermined configuration, there can be obtained the electric connection member which is light in weight and has the simple arrangement.

According to the electric connection member of the present invention, since the contact member is composed of the sheet-shaped or plate-shaped conductor formed to the predetermined configuration, there can be obtained the electric connection member which is light in weight, has the simple arrangement and can be easily manufactured.

According to the electric connection member of the present invention, since the sheet-shaped or plate-shaped conductor is made by removing burrs along the circumference of the conductor formed to the predetermined configuration by stamping or pressing, the leakage of a high-tension voltage caused by the burrs of the conductor can be prevented.

According to the ignition apparatus for internal combustion engine using the electric connection member according to the present invention, since the ignition apparatus for internal combustion engine is composed of the ignition coil for generating a high-tension voltage at an ignition timing of an internal combustion engine and the electric connection member which is formed to be able to be connected to the ignition coil on an end of the adaptor means and to the ignition plug on the other end of the adaptor means, there can be obtained the ignition apparatus for internal combustion engine which exhibits high mechanical and electrical reliability to vibration and further is excellent in processability with a low cost.

According to the method of manufacturing the ignition apparatus for internal combustion engine according to the present invention, the adaptor means, the coil spring and the contact member have first locking means for preventing the coil spring and the contact member from falling off from the adaptor means, and the ignition coil and the ignition plug are disposed after the processes of inserting the coil spring into the inner cavity of the adaptor means so that the first locking means of the coil spring is engaged with the first locking means of the adaptor means and inserting the contact member into the inner cavity of the adaptor means so that the first locking means of the contact member is engaged with the first locking means of the adaptor means. Consequently, even if the adaptor assembly is handled as a single body, the parts such as the coil spring, the contact member and the like do not fall off from the adaptor 20, thus the adaptor assembly is easy to handle and manufacturing processes can be made easy. Further, since the parts such as the coil spring, the contact member and the like do not fall off from the adaptor 20, the coil spring and the like need not be mounted to the adaptor 20 at the time the ignition coil is mounted, as conventionally required. Thus, productivity is improved because an unsuitable coil spring is not mounted to the adaptor by mistake and caution need not be taken to prevent such unsuitable coil springs from being mounted by mistake.

The first rubber cap 13 may be disposed after the coil spring and the contact member are inserted into the adaptor 20. It is possible to provide the contact member with elasticity in a direction normal to the direction toward which the contact member is inserted and insert the coil spring and the contact member under pressure into the adaptor 20 making use of the elasticity after the disposition of the first and second rubber caps 13, 14. Further, it is also possible to provide the first rubber cap 13 and the adaptor 20 with elasticity and insert the coil spring and the contact member under pressure into the adaptor 20 making use of the elasticity after the disposition of the first and second rubber caps 13, 14. Consequently, a sequence of manufacturing processes can be changed, the freedom of the sequence of manufacturing processes can be improved to thereby reduce a cost.

Further, according to the method of manufacturing the ignition apparatus for internal combustion engine using the electric connection member of the present invention, the slender sheet-shaped or plate-shaped conductor is formed and used as the contact member in such a manner that the conductor is formed to the predetermined configuration by stamping or pressing and burrs along the circumference of the conductor are removed. Consequently, the leakage of a high-tension voltage can be easily prevented as well as the ignition apparatus for internal combustion engine can be easily manufactured.

What is claimed is:

1. An electric spark plug connection member comprising:

cylindrical adaptor means defining a cavity extending therethrough and disposed between devices to be electrically connected while insulated therefrom; and conductor means slidably inserted into said cavity of said adaptor means for establishing an electrical connection between said devices, wherein said conductor means is composed of a coil spring and a contact member in electric contact with said coil spring, said contact member comprising one of a folded wire and a folded plate configured so that a portion thereof forms a protrusion engaged in a slot of said adaptor means.

2. An ignition apparatus for an internal combustion engine, comprising:

an ignition coil for generating a high-tension voltage at an ignition timing of said internal combustion engine;

an ignition plug for igniting said internal combustion engine by said high-tension voltage; and an electric connection member for electrically connecting said ignition coil to said ignition plug, wherein said electric connection member comprises: cylindrical insulating adaptor means defining a cavity extending therethrough and mechanically connected between said ignition coil and said ignition plug while electrically insulated therefrom; and conductor means slidably inserted into said cavity for electrically connecting said ignition coil and said ignition plug, and said conductor means is composed of a coil spring and a contact member in electric contact with said coil spring.

3. An ignition apparatus for internal combustion engine according to claim 2, wherein said coil spring and said contact member of said conductor means are integrated with each other.

4. An ignition apparatus for an internal combustion engine according to claim 2, wherein said adaptor means, said coil spring and said contact member have first locking means for preventing said coil spring and said contact member from falling from said adaptor means.

5. An ignition apparatus for an internal combustion engine according to claim 4, wherein said first locking means has elasticity in a direction normal to said direction toward which said contact member is inserted.

6. An ignition apparatus for internal combustion engine according to claim 2, wherein said adaptor means and said contact member have second locking means for preventing rotation of said contact member.

7. An ignition apparatus for an internal combustion engine according to claim 2, wherein said locking means is configured so that a portion of said folded wire forms a provision engaging in a groove of said adaptor means.

* * * * *